US010376938B2

(12) United States Patent
Frauenhuber et al.

(10) Patent No.: US 10,376,938 B2
(45) Date of Patent: Aug. 13, 2019

(54) DEVICE AND METHOD FOR GUIDING METAL STRIPS HAVING WEAR BODIES

(71) Applicant: PRIMETALS TECHNOLOGIES AUSTRIA GMBH, Linz (AT)

(72) Inventors: Klaus Frauenhuber, Linz (AT); Walter Grabner, Neuhofen an der Krems (AT); Friedrich Moser, Hellmonsoedt (AT); Juergen Schiefer, Allhaming (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 667 days.

(21) Appl. No.: 15/024,722

(22) PCT Filed: Sep. 5, 2014

(86) PCT No.: PCT/EP2014/068929
§ 371 (c)(1),
(2) Date: Mar. 24, 2016

(87) PCT Pub. No.: WO2015/043296
PCT Pub. Date: Apr. 2, 2015

(65) Prior Publication Data

US 2016/0214154 A1 Jul. 28, 2016

(30) Foreign Application Priority Data

Sep. 26, 2013 (EP) ..... 13186131

(51) Int. Cl.
*B21B 1/22* (2006.01)
*B21B 39/14* (2006.01)
*B65H 23/032* (2006.01)

(52) U.S. Cl.
CPC ..... *B21B 39/14* (2013.01); *B21B 1/22* (2013.01); *B65H 23/032* (2013.01); *B65H 2701/173* (2013.01)

(58) Field of Classification Search
CPC B65H 23/032; B65H 2701/173; B21B 39/14; B21B 1/22
See application file for complete search history.

(56) References Cited

U.S. PATENT DOCUMENTS 2,818,954 A 1/1958 Vice
5,218,848 A 6/1993 Takakura et al.
(Continued)

FOREIGN PATENT DOCUMENTS

CN 102089092 A 6/2011
CN 202824169 U 3/2013
(Continued)

OTHER PUBLICATIONS

International Search Report dated Dec. 18, 2014 issued in corresponding International patent application No. PCT/EP2014/068929.
(Continued)

*Primary Examiner* — William E Dondero
(74) *Attorney, Agent, or Firm* — Ostrolenk Faber LLP

(57) ABSTRACT

A device for lateral guidance (1) of a metal strip (2) moving on a metal belt conveying device, including at least one base body module (7) includes an essentially vertical guiding plane (10), at least one wear body (12) having a wear surface (12*a*) can be rotated into several defined rotational positions in a controlled manner. The wear surface (12*a*) is substantially planar, and in all of its defined rotational positions, is parallel to the guiding plane (10). Further, a method for lateral guidance of metal strips (2) moving on a metal belt conveying device includes, after a first metal strip has passed through the metal belt conveying device, and prior to a
(Continued)

second metal strip entering the metal belt conveying device, the wear body (12) is rotated from a first to a second defined rotational position in a controlled manner, wherein in all defined rotational positions, the wear surface (12*a*) is parallel to the guiding plane (10).

22 Claims, 9 Drawing Sheets

(56) References Cited

U.S. PATENT DOCUMENTS

| | | | | |
|---|---|---|---|---|
| 5,937,688 | A | 8/1999 | Secen et al. | |
| 6,098,791 | A | 8/2000 | Minnerop | |
| 2011/0132054 | A1 | 6/2011 | Fuchs | 72/200 |

FOREIGN PATENT DOCUMENTS

| | | | |
|---|---|---|---|
| DE | 1427923 | | 1/1969 |
| DE | 69408332 | T2 | 6/1998 |
| EP | 1 118 398 | | 7/2001 |
| JP | S52-150230 | A | 12/1977 |
| JP | S53-50039 | A | 5/1978 |
| JP | S55-165605 | U | 11/1980 |
| JP | S59-215202 | | 12/1984 |
| JP | 60-195106 | | 12/1985 |
| JP | S62-34910 | U | 3/1987 |
| JP | S63-40609 | A | 2/1988 |
| JP | H04-65210 | U | 6/1992 |
| JP | H05-161917 | | 6/1993 |
| JP | H09-174132 | A | 7/1997 |
| JP | 11-216516 | | 8/1999 |
| JP | 2000-042618 | A | 2/2000 |
| KR | 10-0797316 | B1 | 1/2008 |
| KR | 10-2011-0130680 | | 12/2011 |
| RU | 2253524 | C1 | 6/2005 |
| SU | 1069896 | A | 1/1984 |
| SU | 1560345 | A1 | 4/1990 |

OTHER PUBLICATIONS

Written Opinion dated Dec. 18, 2014 issued in corresponding International patent application No. PCT/EP2014/068929.

European Search Report dated Mar. 5, 2014 issued in corresponding European patent application No. 13 18 6131.

Notice of Reasons for Rejection dated Jun. 19, 2017 in corresponding Japanese Patent Application No. 2016-515544 (with English language translation)(total 11 pages).

Russian Federation Notice of Allowance, dated Jun. 18, 2018, issued in corresponding Russian Patent Application No. 2016116014/02(025088). Total 11 pages.

Chinese Office Action, dated Dec. 15, 2016, issued in corresponding Chinese Patent Application No. 201480053160.0. Total 5 pages.

Deletion Request (Löschungsantrag) dated Mar. 22, 2018 for German Patent Application No. 20 2014 011 026.3 with English language translation.

Eco Slide Disc, Operation time extended by a factor of ten, Siemen VAI (Metal Technologies GmbH), Mar. 2014.†

† cited by third party

DEVICE AND METHOD FOR GUIDING METAL STRIPS HAVING WEAR BODIES

CROSS-REFERENCE TO RELATED APPLICATIONS

The present application is a 35 U.S.C. §§ 371 national phase conversion of PCT/EP2014/068929, filed Sep. 5, 2014, which claims priority of European Patent Application No. 13186131.2, filed Sep. 26, 2013, the contents of which are incorporated by reference herein. The PCT International Application was published in the German language.

TECHNICAL FIELD

The present invention relates to a device for laterally guiding a metal strip running over a metal-strip conveying device, the device comprising at least one main body module having a substantially vertical guide plane.

PRIOR ART

During their manufacture, metal strips are directed by means of metal-strip conveying devices, for example by roller tables, to processing machines, for example coiling machines, where the metal strips are wound up. It is necessary here for the metal strips to be subjected to lateral guiding. This is particularly necessary prior to winding up, to as far as possible minimize offset of the individual coilings on the coil in order to achieve a uniform lateral face. Devices for lateral guiding are referred to as guide rulers or run-in rulers, for example. The edges of the running metal strip on which the devices for lateral guiding act cause heavy wear on the wear strips (which are fastened to the guide rulers or to the run-in rulers, respectively) or on the wear faces of said wear strips, respectively. Especially in the case of comparatively thin strips, the strip edges which are guided by way of high lateral forces cut into the wear strips along the entire length of the strip (which may be up to 2000 m in length) while creating sparks. Therefore, depending on the production schedule, the wear faces of the wear strips have to be replaced many times per week.

In order for the effort here to be reduced it is known for not always the entire wear strips of the guide rulers to be replaced but, by for example displacing the wear strips, for new guide faces to be exposed to the strip cutting thereinto. This is described in DE 1427923, for example. It is disadvantageous here that the guide rulers which are complex and expensive in manufacture eventually always have to be replaced. Moreover, there is the risk that in the case of the gap between the roller table rollers and the guide ruler being modified, the gap may assume dimensions which may cause misguiding such as threading or jamming of the metal strip, respectively.

In a variation of the foregoing strategy it is proposed in DE69408332T2 for regions which protrude from the inner delimiting faces of the guide rulers that face the metal strip and which for the purpose of exposing new regions to wear may be displaced to be provided. It is disadvantageous here, that there is a risk during threading the front end of a metal strip that above all in the case of thin strips the edges of the leading strip end may be skewered on the protruding regions and that the metal strip will thus be damaged.

In order to avoid threading of thin metal strips between the roller table rollers, axial spacing of the roller table rollers is usually minimized as far as possible, which is why the protruding regions are very narrow and the guide lengths of the individual protruding regions are thus very short. Intermediate tables which would increase the spacing of the roller table rollers and would increase the guide lengths are mostly avoided so as to avoid threading of the leading strip end and not to damage the already rolled lower side of the strip.

It is proposed in U.S. Pat. No. 2,818,954 for a multiplicity of guide disks which are disposed at an angle to the conveying direction to be provided for guiding. New regions may be exposed to wear by rotating these guide disks.

One known measure for avoiding notches from being cut in provides for rollers which are rotatable about axes which are perpendicular to the running direction of the metal strip to be able to protrude from delimiting faces of the guide rulers, which face the metal strip. Rolling off on such guide rollers reduces the wear thereof and does not allow continuous notches to be created. However, when such rollers are used for lateral guiding of metal strips the risk of the edges of the latter being damaged by the guide rollers increases as the metal strips become thinner. Employing such guide rulers is therefore only possible for metal strips of limited thickness. Moreover, here too, edges of the leading strip end may be skewered on the protruding guide rollers.

In order for damage to the metal strip to be avoided, JP05161917 proposes the use of "umbrella-like rolls" for guiding in a "side guide", which are kept in constant rotary motion by way of a stream of liquid.

SUMMARY OF THE INVENTION

Technical Object

It is an object of the present invention to propose a device and a method for operating the device, which reduce the effort for replacing worn parts and are suitable for all thicknesses of metal strips, without having the mentioned disadvantages.

Technical Solution

This object is achieved by a device for laterally guiding a metal strip running over a metal-strip conveying device, the guiding device comprising at least one main body module having a substantially vertical guide plane, at least one wear body having a wear face, and the wear body, together with the respective wear face thereof, is rotatable in a controlled manner to a plurality of defined rotary positions, and the wear face is substantially planar and in all defined rotary positions, is parallel with the guide plane.

The metal-strip conveying device is for example a roller table, particularly a roller table of a strip coiling plant. The conveying plane of the metal-strip conveying device is typically aligned so as to be substantially horizontal.

The metal strip is a steel strip or an aluminum strip, for example.

The main body module having the guide plane is a so-called guide ruler or a run-in ruler, for example, which for guiding the metal strip has a suitable face, the guide plane. The latter may be formed, for example, by a wear plate (or a plurality thereof) fastened to a support body, wherein the support body and the wear plate(s) collectively then form the main body module.

The device for lateral guiding may comprise a main body module or a plurality of main body modules, for example two main body modules, one for guiding on either side of the metal strip. The guide plane serves for lateral guiding of the metal strip by means of contacting the sides of the metal strip. Said guide plane delimits the freedom of movement of the metal strip in the direction of the former, on account of which the metal strip is laterally guided.

The guide plane is aligned so as to be substantially vertical.

Besides the main body module, the device for laterally guiding additionally also comprises at least one wear body having a wear face.

The wear body is a body which as a result of guiding the metal strip is subject to wear, specifically in a region which is referred to as the wear face.

The wear body is a component which is different from the main body module, but may be inserted into the main body module or be fastened thereto, respectively.

The wear body includes at least one wear face. When guiding the metal strip, the wear face faces the metal strip and is worn by contacting the metal strip in the course of laterally guiding the metal strip.

The metal strip cuts into the wear body, for example in the case of a hot-rolled steel strip which has to be guided at a temperature of around 600° C. and at a speed of approx. 60 km/h, the former being a fundamentally desirable effect since the contours which are cut into the wear body increase its guiding effect for the metal strip. According to one variant, the material of the wear body, or at least of the wear face thereof, may have a hardness selected such that cutting-in of contours which improve guiding is facilitated, on the one hand, and that the wear body replacement intervals are kept at an acceptable level, on the other hand.

According to one embodiment, at least one wear body has at least one support material having a coating. For example, a support material may be surface-coated, for example ceramic-coated, powder-coated, laminated, for example with a material which is more resistant to wear than the support material. A plate may also be applied, e.g. screwed, to a support for example by material, said plate optionally being of a material different from the support material.

A coating, for example a surface coating, of the support material may be comprised of a plurality of layers of dissimilar materials. For example, an external layer may be comparatively soft, so as to facilitate cutting-in of the metal strip for facilitating the configuration of guide splines and a layer lying between the guide splines external layer and the support material may be comparatively hard, impeding cutting-in to a deep extent.

Depending on its desired use, a coating, for example a surface coating, may be identical throughout the wear body or be dissimilar in segments. According to one embodiment, the wear bodies are symmetrical such that after one side is worn, the wear body may be simply reversed and thus another side, which is of identical specification, may face the metal strip and be worn out.

The wear face in the non-worn state is substantially planar. This also comprises that the wear face of the wear body also from the outset, prior to commissioning and in the non-worn new state, may have guide contours for guiding the metal strip, and by way of the metal strip cutting into them, the contours become even deeper during operation. However, the wear face in the non-worn state is preferably embodied in a planar manner without such guide contours.

The wear face is that region of the wear body that during operation is provided for guiding the metal strip. Of course, the wear body may also have regions which during operation will not come into contact with the metal strip, for example on account of the distance of the regions from the pass line of the roller table or from the plane which is defined by the upper edge of the roller table rollers, respectively.

The wear body may be round or have other contours. The wear body may also be configured like a wheel having spokes, wherein the rim of the wheel contains the wear face or forms the latter, respectively, and the spokes fix the rim to a rotation axle.

The wear body may also be laterally chamfered in order to avoid the risk of the metal strip being skewered on the periphery of the wear body. If the wear body is a disk, for example, it is chamfered between the lateral face and the main face of the disk.

The wear body, preferably outside the wear face, may have guide elevations. It is demonstrated in practice that metal strips may have a tendency to climb on the wear bodies, that is for the spacing of the metal strips from the lowermost end of the wear body to be increased.

To avoid such undesirable climbing, guide elevations which prevent climbing and departing from the wear face may be provided on the wear body and optionally force the metal strip downward again. Such guide elevations may be, for example a plurality of, discrete elevations on a face of the wear body which lies in one plane with the wear face, that is to say individual elevations which are separate from one another on a plane. Or the wear body may be embodied in such a manner that an elevation in relation to the plane of the wear face is provided on a periphery of the wear face next to the wear. This elevation is either present on the entire periphery of the wear body or has interruptions, so that it is only partially present on the periphery. The elevation here is preferably embodied such that the former does not rise abruptly from the plane of the wear face up to a fixed height but the height of the elevation increases as its spacing from the periphery of the wear face increases, which is referred to as a run-up slope.

A guide elevation, especially a run-up slope, constricts the lateral space for the metal strip during operation. The constriction provides resistance to counteract climbing of the metal strip.

The wear body is rotatable in a controlled manner to a plurality of defined rotary positions. The wear body may assume at least two defined rotary positions and an operator may select between the positions in a targeted manner and may accordingly control and/or regulate rotation in the controlled manner.

A plurality of wear bodies are preferably present so that guiding may be performed to an increasing extent by the wear bodies.

All wear bodies are preferably embodied according to the invention. On account thereof, maximum benefit is derived from the advantages which are associated with the device according to the invention.

Advantageous Effects of the Invention

In comparison with U.S. Pat. No. 2,818,954 which has guide disks which are disposed at an angle to the conveying direction, the device according to the invention, has a wear face which is substantially planar and parallel with the guide plane. This allows for a longer guide length for the metal strip. A comparatively lower bearing pressure is generated, which presents a lower risk of damage to an edge of the metal strip and therefore enhances the ability for thinner strips to be handled. On the other hand, there is less wear on the wear bodies, leading to increased service life or to a lower requirement replacements, and a replacement interval may be six times longer in practice.

As opposed to JP05161917, the apparatus hereof has rotating rollers, which assume defined rotary positions according to the invention. This leads to an improved guiding function on account of the metal strip cutting into the wear body and to improved distribution of wear across various regions. Therefore, comparatively thinner metal strips may be handled, for example.

The wear bodies are preferably replaceable, so that these components may be readily replaced if there is excessive wear. Replacement of the main body modules, or of parts of the main body modules, such as wear plates, for example, which in comparison is a more complex procedure, is more rarely required. This provides savings of effort and costs for maintaining the device for lateral guiding.

In one embodiment, a plurality of the wear bodies have a wear face, and those wear bodies are rotatable to a plurality of defined rotary positions. At least one of these wear bodies is rotatable independently of other wear bodies. As a result, the extent of wear on individual wear bodies may be considered when exposing new regions of the wear bodies, and rotating may be performed in an individual manner, as needed. This may further lower the effort for renewing worn-out wear bodies.

According to one embodiment, a plurality of wear bodies having a wear face are present, and which are rotatable to a plurality of defined rotary positions. At least one of these wear bodies is rotatable dependent with at least one other of these wear bodies. As a result, the extent of wear on groups of at least two wear bodies may be considered when exposing new regions of the body or the wear face, and such groups may be rotated depending on necessity. This may further lower the effort for renewing worn-out wear bodies.

A wear body is rotatable about a rotation axis. Once wear of a region of the wear face of the wear body exceeds an acceptable extent, the wear body may be rotated in a controlled manner about the rotation axis, to turn an as yet unspent region to face the edge of the metal strip to be worn by that edge. The requirement for replacing the wear face or the wear body, respectively, may be delayed by way of repeated controlled rotation, since new and as yet non-worn regions are turned to face the edge of the metal strip.

In terms of the circumference of the wear body as viewed in the direction of the rotation axis, is preferably substantially axially symmetrical, and particularly preferably is rotationally symmetrical. This comprises that the periphery of the wear body having clearances which in sections interrupt a circumference of this type. For rotationally symmetrical wear bodies, this has the advantage that for rotation by 360/n degrees, wherein n equals the count of rotational symmetry, the extent of lateral guiding by way of the wear bodies in the sense of contact between the metal strip and the wear face is substantially uninfluenced by whether and how frequently the wear body has been rotated about 360/n degrees proceeding from an initial position, wherein the length along which guiding takes place, i.e. the guided length, remaining identical.

In the case of rotationally symmetrical wear bodies this applies in a corresponding manner, even independently of the rotation angle.

The wear body is particularly preferably a round disk of which the base area forms the wear face of the wear body and round disk is rotatable about a rotation axis which is perpendicular to the wear face of the wear body, wherein the rotation axis lies in the center of the round disk. In this case, the wear body is rotationally symmetrical in relation to the rotation axis. In this way, the metal strip is always guided by the wear face along an identical length, independently of the rotary position in which the wear body is located, that is independently of how many degrees the wear body has been rotated proceeding from an initial position. The extent of lateral guiding by the wear body, in the sense of contact between the metal strip and the wear face, thus remains substantially uninfluenced by how much the wear body has been rotated, proceeding from an initial position. Of course, the length along which the metal strip is guided by the wear face may vary slightly on account of other factors, for example, depending on whether the metal strip happens to run in existing cuts in the wear face, which forces the metal strip into a slightly varied running direction.

The wear body may also have other shapes than a round disk, such as, a polygonal disk or a hexagonal disk.

According to one preferred embodiment at least one wear body may be disposed in a clearance of the at least one main body module. When the at least one wear body is disposed there, it is possible for simultaneous guiding of the metal strip by the main body module and by the wear body, for example when the wear face of the wear body does not protrude beyond the guide plane of the main body module but at least partially lies in the latter. This may occur when the wear face is substantially planar and parallel with the guide plane, as is required according to the invention, since parallel with the guide plane also comprises being in the same plane as the guide plane. Or, it may occur when the wear face of the wear body does not protrude beyond the guide plane of the main body module and does not lie therein, but is at a greater distance from the metal strip than the guide plane of the main body module, and specifically when the metal strip cuts into the main body module to such an extent that the metal strip also comes into contact with the wear face and is guided by the latter.

The clearance is preferably round. This enables simple rotation of a wear body which is disposed in the clearance when the latter in relation to the rotation axis of the wear body is axially symmetrical or rotationally symmetrical.

When the clearance is not completely enclosed by the main body module, the periphery of the clearance in the main body module in this embodiment follows part of a circle.

The clearance may also have other shapes.

The wear body, and optionally the clearance, is disposed such that the part which plunges below the upper edge of the roller table is as large as possible.

The metal strip substantially runs along the upper edge of the roller table. The larger is the part of the wear body, especially of a rotationally symmetrical wear body, and in particular of a round disk as a wear body, that plunges below the upper edge of the roller table, the longer is the length that is offered by the wear body as a guide to the metal strip, causing better guiding.

For a round wear body and a roller table having roller table rollers as a metal-strip conveying device, it is therefore preferable for the rotation axis for the rotatable wear body to be above the center between the rotation axes of the roller table rollers. Then implementation of a maximum guide length is possible for the respective wear body in the respective roller table, since the wear body in such a case may plunge deeper into the intermediate space between the roller table rollers than if the rotation axis were laterally offset in relation to the center between the roller table rollers.

An embodiment is preferable in which the wear body in a round clearance is embodied as a round disk of which the base area forms the wear face of the wear body and which is rotatable about a rotation axis which is perpendicular to the wear face thereof, and wherein the rotation axis lies in the center of the round disk The wear body is preferably disposed in the clearance with an exact fit, of course having a small gap so as to enable rotating movement. There is then only a slight risk of edges of the leading strip end being skewered on gaps between the wear body and the guide plane, and the wear body may be rotated without the necessity for additional movements of the wear body. For a wear body which is embodied as a polygonal disk in a clearance with an exact fit, rotating the wear body would only be possible for example, once the wear body has been moved out of the guide plane, wherein after rotation, the polygonal disk would have to be moved back into the guide plane. This costs time and requires suitable driving units.

For a polygonal disk in a clearance with an exact fit it is advantageous that there practically is a safeguard against inadvertent rotation of the wear body, that is that defined rotary positions are defined by the shape of the clearance.

When the clearance is to enable rotation without such outward/inward movement, a sufficiently large gap has to be present between the periphery of the clearance and the polygonal disk. This has the disadvantage that corners of a leading strip end may be skewered on such gaps.

According to one embodiment, the device according to the invention comprises at least one wear body for which the spacing of the wear face thereof from the guide plane of the main body module is readjustable. In this way, the wear body or the main body module may be spaced from a metal strip that is to be guided and the spacing may be adjusted at various positions. For example, when the wear body touches the metal strip, the spacing of the wear face of the former from the guide plane of the main body module may be modified for example such that the main body module is moved away from the metal strip. In another variant, the wear body is moved in the direction of the metal strip such that the spacing of the wear face of the former from the guide plane of the main body module is increased, for example until the wear body is in contact with the metal strip. Here, lateral freedom of movement for the metal strip is more and more reduced.

In a so-called guiding position, at least part of the wear body lies outside the guide plane of the main body module, specifically in the direction of the edge of the metal strip to be guided. That part is thus located closer to the metal strip to be guided than is the main body module. Lateral guiding of the metal strip is then primarily carried out by this part of the wear body or of the wear face thereof, respectively, and not by the guide plane of the main body module. In this way, the main body module which is expensive and complex to make is worn to a significantly lesser extent. Apart from the run-in of the lead strip end, the main body module is prone to almost no wear at all.

For example, the wear bodies may be set to the guiding position, in which the former assume exclusive guiding of the strip, as soon as the leading strip end of the metal strip has passed the device for lateral guiding, since there is then no longer any risk of the corner of the leading strip end being skewered. Wear of the expensive main body module is then significantly reduced Instead, according to the invention, the wear body which is manufacturable in a cost-effective manner is worn.

During the run-in of the leading strip end, there would be the risk in the case of wear bodies in the guiding position that the corners of the leading strip end would be skewered on these wear bodies. For such a phase, the wear bodies, for example by retracting into clearances of the main body module, may be readjusted such that they no longer protrude from the guide plane and there is thus no longer the risk of a leading strip end at the corners thereof being skewered on elevations from the guide plane.

In a so-called main body position, the wear body may assume lateral guiding of the metal strip, optionally collectively with the guide plane of the main body module. The metal strip in this case will wear both the guide plane of the main body module as well as the wear face of the wear bodies.

For example, the wear body may be readjusted by means of respective readjustment devices to be pushed out of the guide plane by a movement which is perpendicular to the guide plane. Upon being displaced in a perpendicular manner, the entire wear face in the guiding position lies outside the guide plane and all points of the wear face are equidistant to the guide plane, facilitating uniform wear by the metal strip.

Displacement performed in a manner perpendicular to the guide plane is particularly preferable, for example, when the wear body is a round disk of which the base area forms the wear face of the wear body and the disk is rotatable about an axis which is perpendicular to the wear face thereof, wherein the rotation axis is in the center of the round disk. Displacement is performed in the direction of the rotation axis which is also perpendicular to the guide plane. An embodiment of this type is particularly easy to construct.

According to a special embodiment, for at least one wear body, the spacing of the wear face thereof from the guide plane of the main body module is readjustable independently of other wear bodies.

It is then possible for the number of wear bodies providing lateral guiding to be varied, for example depending on the requirements of the metal strip being guided. Particular consideration may then be given in a targeted manner to the requirement for guiding by means of the guide plane or of the wear bodies in special regions of the device and individual readjustment for each wear body may be performed in such regions. In this way, the wear of wear bodies which are not necessarily required may be reduced, and the maintenance effort thus required may be minimized many times.

All wear bodies are preferably embodied in this way.

According to another embodiment thereof, a plurality of wear bodies for which the spacing of the wear face thereof from the guide plane of the main body module is readjustable are present, and the spacing of at least one of these wear bodies is readjustable dependent on at least one other of these wear bodies.

Then consideration may be given in a targeted manner to the requirement for guiding by means of the guide plane or of the wear bodies in special regions of the device which extend across the extent of groups of wear bodies and readjustment for such groups may be performed according to requirements. This may further lower the effort for renewing worn-out wear bodies, and simplifies operation and requires less constructive complexity as compared with mutually independent readjustability.

Preferably, all of these wear bodies are readjustable dependent on at least one other of these wear bodies, that is, that all wear bodies are readjustable in a linked manner.

Preferably, the at least one wear body for which the spacing of the wear face thereof from the guide plane of the main body module is readjustable is readjustable while the strip is running.

According to one preferred embodiment, the device has at least one wear-body guide roller which is guided through a clearance of the wear face of a wear body or an opening of the wear face of a wear body and at least partially protrudes from this wear face. For guiding the metal strip being conveyed, the wear roller preferably is on a vertically oriented axis when in its position to guide the strip.

An opening of the wear face is to be understood as a hole in the wear face, which is entirely surrounded by the wear face. By contrast, a clearance of the wear face is not entirely surrounded by the wear face.

Accordingly, the advantage of lateral guiding by guide rollers may be utilized if and when required in the device according to the invention, and if this is no longer desired or required, for example in the case of thin metal strips having thicknesses up to 5 mm, lateral guiding may again be provided by the wear faces.

The presence of wear-face guide rollers has the advantage that a selection may be made between guiding by means of wear-body guide rollers and guiding by means of wear bodies, depending on the thickness of the metal strip to be guided. Or a selection may be made between guiding by means of wear-body guide rollers and guiding by means of wear bodies, depending on whether or not there is a risk of corners of the leading strip end being skewered or edges of the metal strip being damaged.

According to one preferred embodiment, the device has at least one wear-body guide roller which is adjustable to at least

- one parking position with the guide rollers out of range of contact with the lateral edge of the metal strip and
- one guiding position with the guide rollers in position to guide the edge of the metal strip.

In the guiding position, the wear-body guide roller is suitable for laterally guiding the metal strip running over the metal-strip conveying device. In the parking position, the wear-body guide roller is not so suitable. The metal strip is then guided by the wear body and/or the guide plane.

According to one embodiment, the wear-body guide roller is fastened to or on a wear body. Preferably, the wear-body guide roller is adjustable by rotating the wear body to a parking position or a guiding position.

The wear-body guide roller may also be fastened to the main body module or to other parts of the device, or to adjacent devices.

According to one preferred embodiment, in the guiding position the roller face of the wear-body guide roller is guided through a clearance of the wear face of a wear body or an opening of the wear face of a wear body or at least partially protrudes from this wear face.

According to one variant, in the parking position, the roller face of the wear-body guide roller here, viewed from the edge of a metal strip to be guided in the direction of the wear face, lies beyond the wear face. When the roller surface of the wear-body guide roller, viewed in the direction of the wear face, lies beyond the wear face, or in other words below the wear face, the roller surface does not contribute toward lateral guiding. In the guiding position, the roller face of the wear-body guide roller at least partially protrudes from the wear face, when viewed from the wear face away in the direction of the guide plane of the main body module, or in other words, when viewed toward the edge of a metal strip to be guided. The metal strip then primarily comes into contact with the wear-body guide rollers and is primarily guided by the latter instead of by the wear face.

In the guiding position, the rotation axis of the wear-face guide rollers here preferably lies such that the wear-body guide rollers are set in rotary motion by contact with the metal strip. This may be a then vertically oriented axis for a strip passing horizontally by the rollers. This makes for low wear of the wear-body guide rollers, since at least part of the energy which upon contact is transmitted from the metal strip to the wear-body guide roller is converted to rotation of the rollers instead of contributing toward signs of wear. Here, the rotation axis of the wear-body guide roller is preferably substantially perpendicular to the running direction of the metal strip.

The wear-body guide roller may be adjusted from the parking position to the guiding position and reversed therefrom by being displaced, folded out or in, respectively, or pivoted.

According to another variant, the roller face of the wear-body guide roller in both the parking and the guiding positions at least partially protrudes from the wear face, when viewed from the wear face in the direction of the metal strip. The position of the opening or clearance of the wear face and of the wear-face guide roller protruding from this opening or clearance is modified by pivoting the wear body. Accordingly, the guiding position may be adjusted by pivoting the wear body to a position in which a metal strip to be guided may come into contact with the wear-body guide roller and, on account thereof, be guided. A selection between guiding by means of wear bodies and guiding by means of wear-body guide rollers may thus be readily performed. In the guiding position, the rotation axis of the wear-body guide rollers lies preferably such that the wear-body guide rollers are set in rotation by way of contact with the metal strip. This makes for low wear of the wear-body guide rollers, since at least part of the energy which upon contact is transmitted from the metal strip to the wear-body guide roller is converted to rotation of the rollers instead of contributing toward signs of wear. Here, the rotation axis of the wear-body guide roller is preferably substantially perpendicular to the running direction of the metal strip.

In the parking position, the wear body or the opening in the wear face, respectively, is positioned such that the wear-body guide roller which protrudes from the wear face does not come into contact with the metal strip to be guided. Guiding of the metal strip is instead performed by the wear bodies.

Accordingly, the advantage of lateral guiding by wear-body guide rollers may be utilized if and when required in the device according to the invention by adjusting the wear-body guide roller, and if this is no longer desired or required, for example in the case of thin metal strips having thicknesses up to 5 mm, lateral guiding may again be provided by the wear faces, by adjusting the wear-body guide roller to the parking position.

The provision of wear-body guide rollers thus has the advantage that a selection may be made between guiding by means of wear-body guide rollers and guiding by means of wear bodies, depending on the thickness of the metal strip to be guided. Or a selection may be made between guiding by means of wear-body guide rollers and guiding by means of wear bodies, depending on whether or not there is a risk of corners of the leading strip end being skewered or edges of the metal strip being damaged. For example, there is a very slight risk or no risk at all of the strip edges of the leading strip end being damaged by projecting rollers in the case of thick metal strips, for example having a thickness of more than 5 mm. Therefore, in the case of thick metal strips the wear-body guide roller will be brought to the guiding position even before the metal strip runs in.

Likewise, a combination of guiding the metal strip by wear-body guide rollers and wear bodies which are upstream or downstream of the wear-body guide rollers is possible.

A further subject matter of the present application is a method for laterally guiding metal strips running over a metal-strip conveying device, by means of a device for laterally guiding a metal strip. The device comprises at least one main body module having a guide plane and at least one wear body having a substantially planar wear face. In the method, after a first metal strip has passed through the metal-strip conveying device and before a second metal strip runs into the metal-strip conveying device, the wear body is rotated in a controlled manner from a defined first rotary position to a defined second rotary position, wherein the wear face in all defined rotary positions is parallel with the guide plane.

There are two or more defined rotary positions. The terms first rotary position and second defined rotary position merely mean that these are two different rotary positions. In this context, this does not mean that there are mandatorily merely two rotary positions.

The term first metal strip and second metal strip merely mean that there are two different metal strips. In this context, this does not mean that there are mandatorily merely two metal strips. In this context, this does not mean that rotating must always take place between two successive metal strips. Rotating may also only take place once a plurality of metal strips have run through the device, prior to a further metal strip running through the device, prior to rotating taking place again, again a plurality of further metal strips may follow the further metal strip.

For example, ten metal strips may initially run through the device. Then rotating is performed prior to an eleventh metal strip running through the device as the first metal strip of a group of ten further metal strips. No rotating takes place while metal strip eleven to metal strip twenty run through the device.

In this way, fresh regions of the wear body may be exposed to wear in a defined manner, wherein the guide length is preferably not modified by a modified orientation of the wear faces.

According to one embodiment, after a first lateral guiding phase on at least one side of the metal strip by means of the main body module and optionally by wear bodies and/or wear-body guide rollers in a subsequent second lateral guiding phase, lateral guiding on at least one side of the metal strip is performed only by wear bodies.

The device for laterally guiding a metal strip optionally also comprises at least one wear-body guide roller.

Here, in the case of lateral guiding in the second lateral guiding phase only by means of wear bodies, one wear body or a plurality of wear bodies may laterally guide.

A first phase of lateral guiding is here referred to as the first lateral guiding phase. A second phase of lateral guiding is here referred to as the second lateral guiding phase.

As has been previously described, there are phases of lateral guiding for a metal strip to be guided in which it is advantageous for a metal strip to be guided by means of the guide plane, without elevations protruding from the latter, for example in the run-in of the leading strip end. This causes wear on the guide plane. In such a phase, a wear body in the main body position, which is a position in which the former does not form an elevation on the guide plane, may optionally also assume lateral guiding of the metal strip collectively with the guide plane of the main body module. In this case, the metal strip will wear both the guide plane of the main body module as well as the wear face of the wear body.

Once the necessity for such lateral guiding for the respective metal strip has elapsed, for example when the leading strip end has left the region of the device according to the invention, wear of the guide plane is avoided according to the invention in that guiding for the majority of the metal strip is performed only by means of the wear body.

This may be achieved by the device hereof by at least one wear body for which the spacing of the wear face thereof from the guide plane of the main body module is readjustable.

In this way, the spacing of the wear face from the guide plane and thus also the spacing from the metal strip to be guided may be adjusted to a position in which the wear face is closer to the metal strip than is the guide plane of the main body module, i.e. the guiding position.

For example, the wear bodies or the wear faces, respectively, may be adjusted to the guiding position in which the wear body exclusively assume guiding of the strip as soon as the leading strip end of the metal strip has passed the device for lateral guiding There is then no longer any risk of the corners of the leading strip end being skewered. Wear of the main body module is then significantly reduced for the majority of the length of the strip.

According to another embodiment, after a first lateral guiding phase on at least one side of the metal strip by the main body module and optionally by wear bodies and/or wear-body guide rollers, a subsequent second lateral guiding phase lateral guiding on at least one side of the metal strip is performed in one of the following manners:

only by means of wear-body guide rollers, by means of wear bodies and wear-body guide rollers.

In this case the device for laterally guiding a metal strip also comprises at least one wear-body guide roller.

For lateral guiding in the second lateral guiding phase by only wear-body guide rollers, one wear-body guide roller or a plurality of wear-body guide rollers may laterally guide here.

For lateral guiding in the second lateral guiding phase by wear bodies and wear-body guide rollers, one wear body or a plurality of wear bodies, and one wear-body guide roller or a plurality of wear-body guide rollers may laterally guide here.

Preferably, after the first lateral guiding phase, at least one wear body and/or the at least one main body module are/is readjusted to a position in which the wear face of the wear body lies outside the guide plane. For example, during the first lateral guiding phase, a wear body wear face which lies within the guide plane may be moved farther in the direction of the metal strip to be guided. Or the guide module may be moved farther in the direction away from the metal strip to be guided, such that the wear body which remains in the original position is located closer to the metal strip than is the guide module.

Lateral guiding of the metal strip in the second lateral guiding phase is performed by at least one wear-body guide roller. As has been previously described, it is at times advantageous for a guiding function to be assumed by wear-body guide rollers.

According to one preferred embodiment, the method according to the invention is carried out such that during the second lateral guiding phase lateral guiding is performed on at least one side of the metal strip by means of a plurality of wear bodies, wherein during the second lateral guiding phase, at least one wear body while losing contact between the wear face of the latter and the metal strip is readjusted away from the metal strip.

This wear body then is rotated in a controlled manner about a rotation axis to a defined new rotary position, and this wear body then while restoring contact between the wear face of the latter and the metal strip, is readjusted toward the metal strip.

It is then possible to be able to react to a wear-related requirement for reinforcement of the prevailing guide function while the strip is running. Worn-out wear bodies may be pivoted to positions in which as yet non-worn regions of the wear face thereof are exposed to the metal strip while the strip is running.

According to a preferred embodiment, the manner of lateral guiding is switched between sliding guiding by means of wear bodies and rolling guiding by means of rollers. The rollers may be wear-body guide rollers or other rollers for guiding.

According to one variant, the manner of lateral guiding is switched between sliding guiding and rolling guiding during lateral guiding of a metal strip. One step here may be rotating the wear body to a new defined rotary position, or displacing, folding in or out, respectively, or pivoting wear-body guide rollers or other rollers for guiding.

According to one preferred embodiment, the manner of lateral guiding comprises both sliding guiding by means of wear bodies as well as rolling guiding by means of rollers. The rollers may be wear-body guide rollers or other rollers for guiding.

The device and the method according to the invention allow the maintenance effort to be significantly reduced in comparison with conventional devices. The temporal effort for replacing worn-out parts is reduced, since by way of multiple exposure of as yet non-worn regions of the wear face of a wear body to a metal strip, the wear bodies need less frequent replacement than conventional wear strips. Replacement may be performed in the course of other maintenance downtime. In this way, production losses as a result of short maintenance intervals for wear faces may be avoided. Also, the effort in terms of costs for replacing wear bodies is minimized, since the wear bodies may be made in a simple and cheap manner.

BRIEF DESCRIPTION OF THE DRAWINGS

The present invention will be described hereunder in an exemplary manner by means of a plurality of schematic figures.

DESCRIPTION OF EMBODIMENTS

Figure 1:
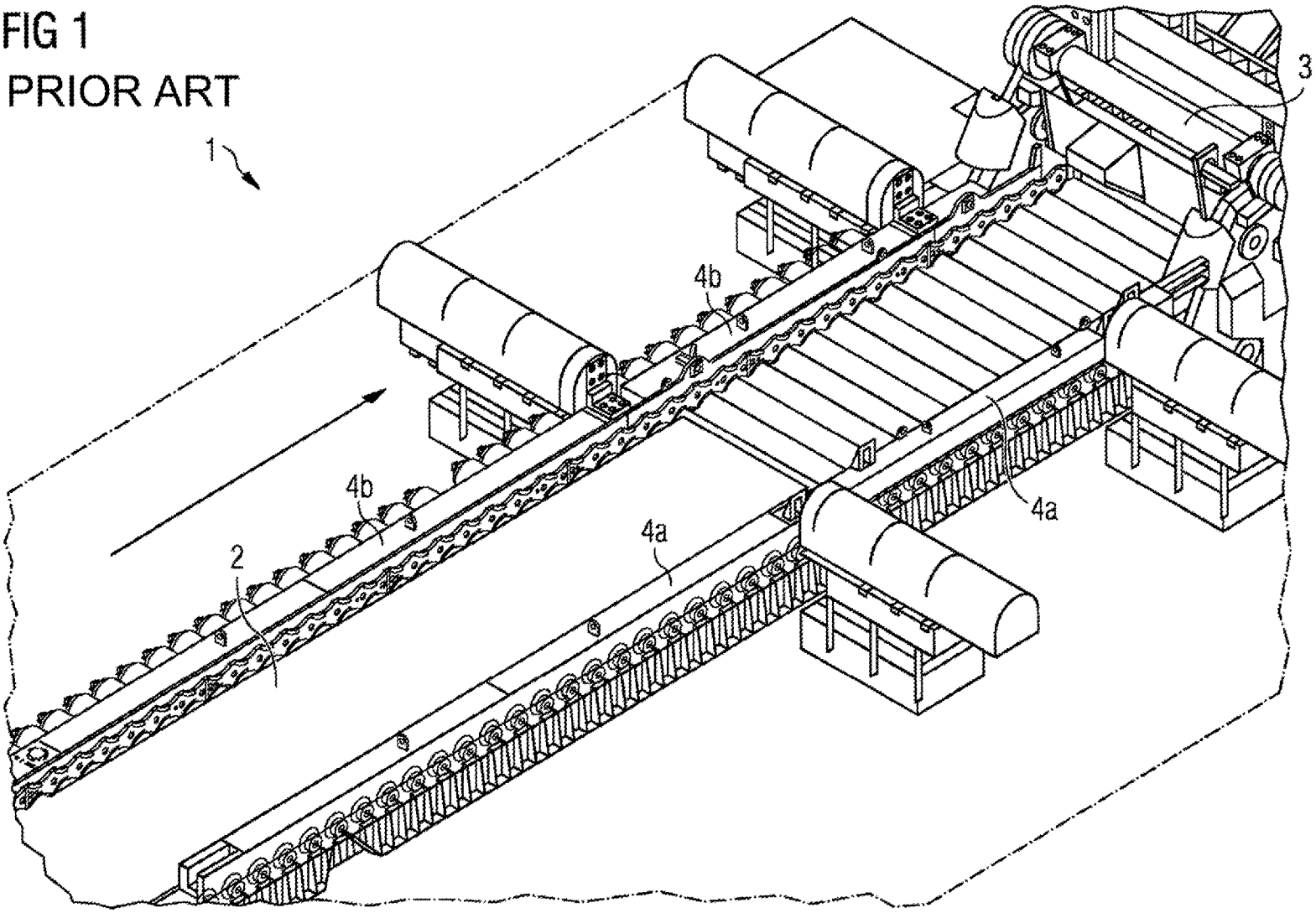
FIG 1 PRIOR ART
FIG. 1 schematically shows a conventional device for laterally guiding a metal strip running over a roller table.

FIG. 1 schematically shows a conventional device 1 for laterally guiding a metal strip 2 running over a roller table, in a perspective view from above. The metal strip 2 runs in the direction of the arrow in the direction of a driver 3 of a coiling plant. Said metal strip is laterally guided by means of the run-in rulers 4*a*, 4*b*.

Figure 2:
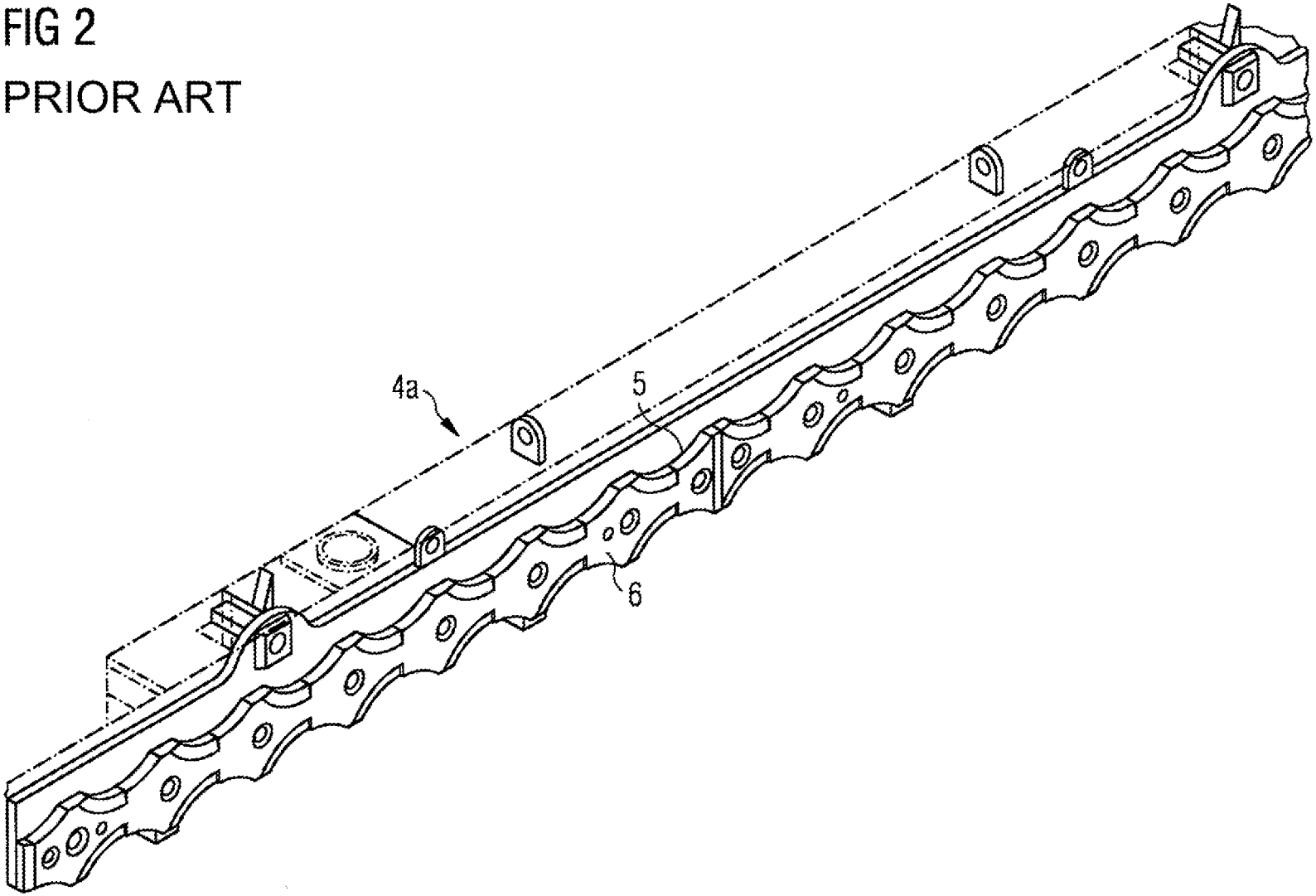
FIG 2 PRIOR ART
FIG. 2 shows part of a wear strip of a run-in ruler of a known device for laterally guiding a metal strip running over a roller table.

FIG. 2 shows part of a wear strip 5 of a run-in ruler 4*a* or 4*b* of a known device 1 of FIG. 1, for laterally guiding a metal strip running over a roller table. A metal strip is guided by means of the guide plane 6. The wear strip here is worn-out and needs to be replaced.

Figure 3:
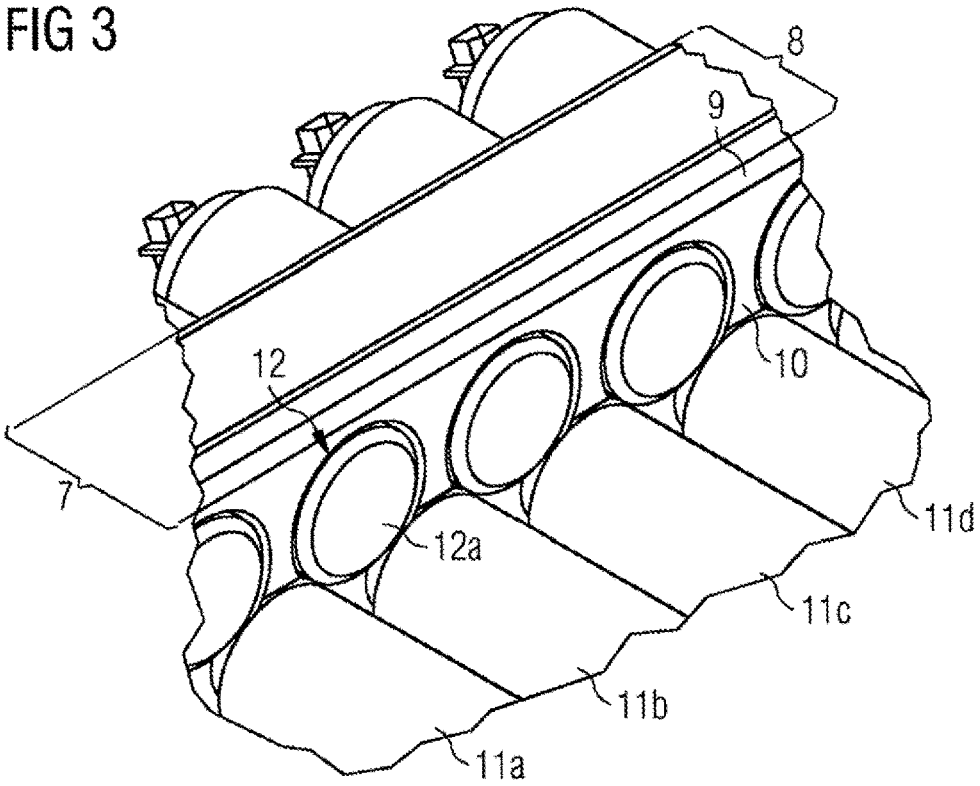
FIG. 3 shows a fragment of a device according to the invention for laterally guiding a metal strip running over a roller table

FIG. 3 shows a fragment of a device according to the invention for laterally guiding a metal strip running over a roller table as a metal-strip conveying device. Of the device, a main body module 7 comprised of a support body 8 carrying a wear plate 9 having a substantially vertical guide plane 10 is shown. Also illustrated are roller table rollers 11*a*, 11*b*, 11*c*, 11*d*. A wear body 12 of which the wear face 12*a* in the illustration lies in the same plane as the guide plane 10 is also illustrated. The wear body 12 is rotatable in a controlled manner to a plurality of defined rotary positions. The wear face 12*a* is substantially planar and in all defined rotary positions is parallel with the guide plane 10. The wear body 12 is a round disk of which the base area forms the wear face of the wear body. The wear body 12 is disposed in a largely round clearance of the wear plate 9; since the wear plate 9 does not fully encompass the wear body 12, the clearing is not entirely round, however, the part comprising the wear body 12 is part of a circle.

Also seen are chamfers between the base area and lateral faces of the round disks of the wear body 12. The chamfers, as compared to wear bodies without chamfers, avoid the risk of the metal strip being skewered on the periphery between the lateral faces and the base area.

In an example which is analogous to FIG. 3 and which is not separately illustrated, the wear body is pivotable about a rotation axis which is perpendicular to the guide plane. The rotation axis is in the center of the round disk. The rotation axis is disposed above the center, to be between the rotation axes of the roller table rollers.

Figure 4:
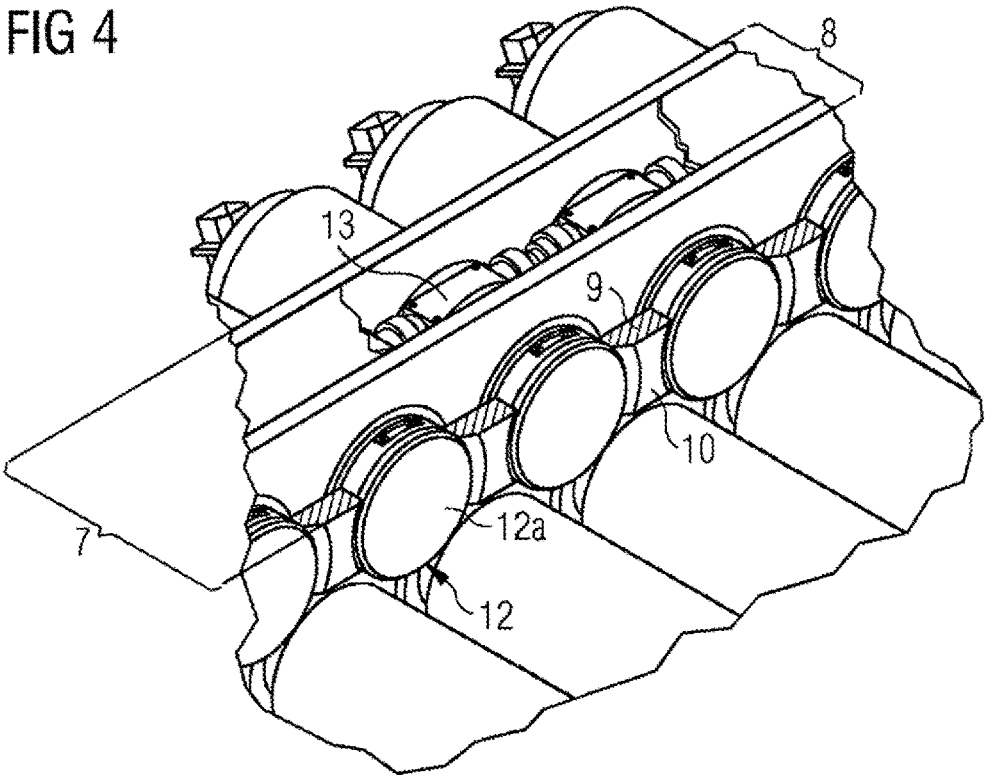
FIG. 4 shows a device as in FIG. 3, in a sectional view.

FIG. 4 shows a device as in FIG. 3 in a sectional view. The main body module 7, comprised of a support body 8, and the wear plate 9, in the sectional view, having the guide plane 10 are seen. The wear body 12 is fastened to a readjustment device, presently a rotary readjustment module 13, which is fastened in the main body module 7. The wear body 12 may be rotated in a controlled manner to a plurality of defined rotary positions by the rotary readjustment module 13. Moreover, by means of the rotary readjustment module 13 the spacing of the wear face 12*a* from the guide plane 10 of the main body module 7 may be readjusted wherein the wear body 12 may be moved out of the guide plane 10 and back into that plane, this not being separately illustrated.

Figure 5:
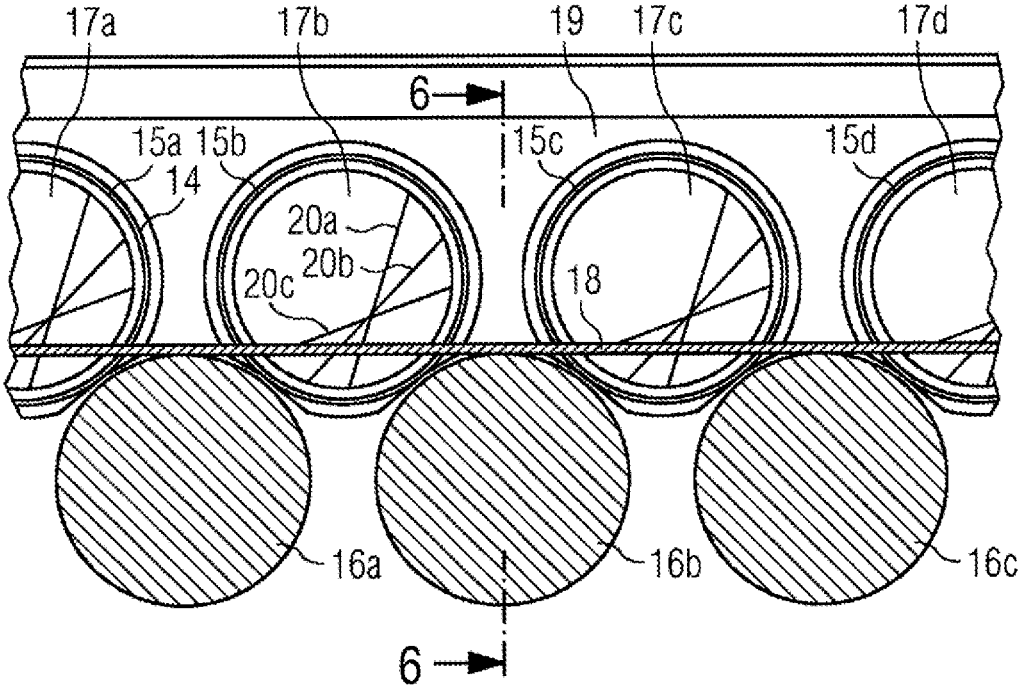
FIG. 5 shows wear bodies for a device according to the invention, disposed in clearances of the main body module.

FIG. 5 shows wear bodies 15*a*, 15*b*, 15*c*, 15*d* which are disposed in largely round clearances of a main body module 14. Roller table rollers 16*a*, 16*b*, 16*c* are likewise illustrated. The wear bodies 15*a*, 15*b*, 15*c*, 15*d* are round disks and their base areas form the wear faces 17*a*, 17*b*, 17*c*, 17*d* of the wear bodies 15*a*, 15*b*, 15*c*, 15*d*. The wear bodies 15*a*, 15*b*, 15*c*, 5*d* are rotatable in a controlled manner to a plurality of rotary positions, wherein their substantially planar wear faces are parallel with the guide plane 19 in all defined rotary positions. The metal strip 18 presently a steel strip, is guided by the guide plane 19 and the wear bodies 15*a*, 15*b*, 15*c*, 15*d*. The wear faces 17*a*, 17*b*, 17*c*, 17*d* of the wear bodies lie in the guide plane 19. Also illustrated are a plurality of wear tracks 20*a*, 20*b*, 20*c* for the wear body 15*b*, which have already been carved by the metal strip into the wear bodies 15*b* after the bodies have been repeatedly rotated in a controlled manner to various defined positions.

Figure 6:
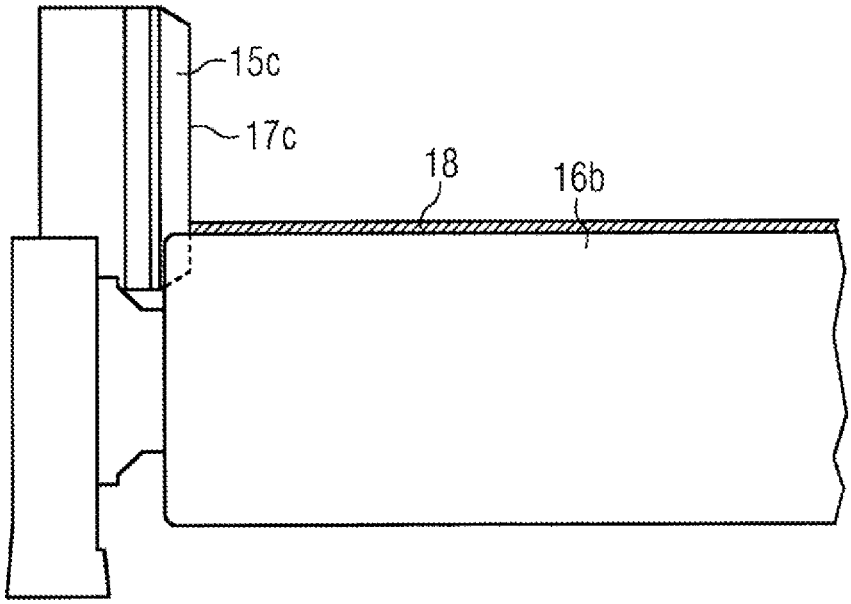
FIG. 6 shows a view along the section 6-6 of FIG. 5.

FIG. 6 shows a view along the section B-B of FIG. 5, in the direction of the wear body 15*c*, wherein the guide plane 19 is not separately illustrated.

Figure 7:
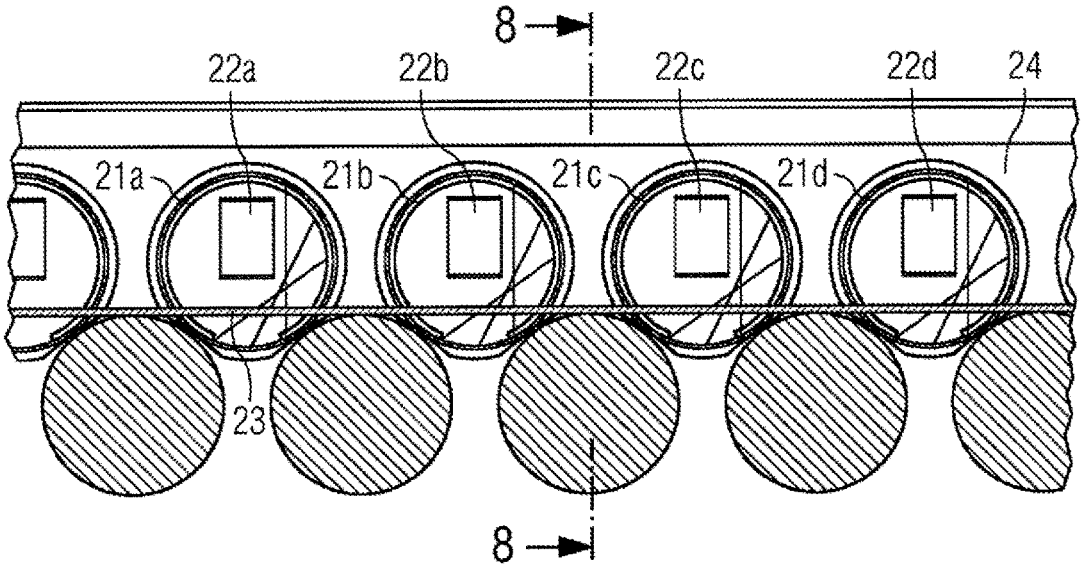
FIG. 7 shows a device according to the invention, having wear-body guide rollers in the parking position.

FIG. 7 shows a device which is largely analogous to that of FIG. 5, having wear bodies 21*a*, 21*b*, 21*c*, 21*d*. These also are wear-body guide rollers 22*a*, 22*b*, 22*c*, 22*d* which are adjustable to at least one parking position or one guiding position. The wear-body guide rollers in FIG. 7 are shown in the parking position. The metal strip 23, presently a steel strip, is guided by the guide plane 24 and the wear bodies 21*a*, 21*b*, 21*c*, 21*d* which have the wear faces lying in the guide plane 24.

Figure 8:
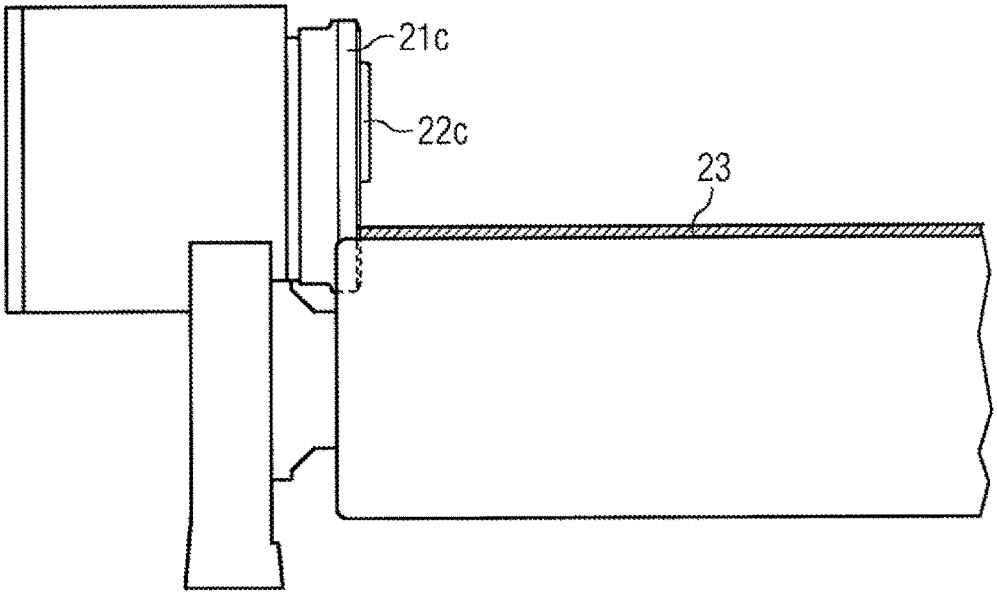
FIG. 8 shows a view along the section 8-8 of FIG. 7.

FIG. 8 shows a view along the section 8-8 of FIG. 7, in the direction of the wear body 21*c*, wherein the guide plane 24 is not separately illustrated.

Figure 9:
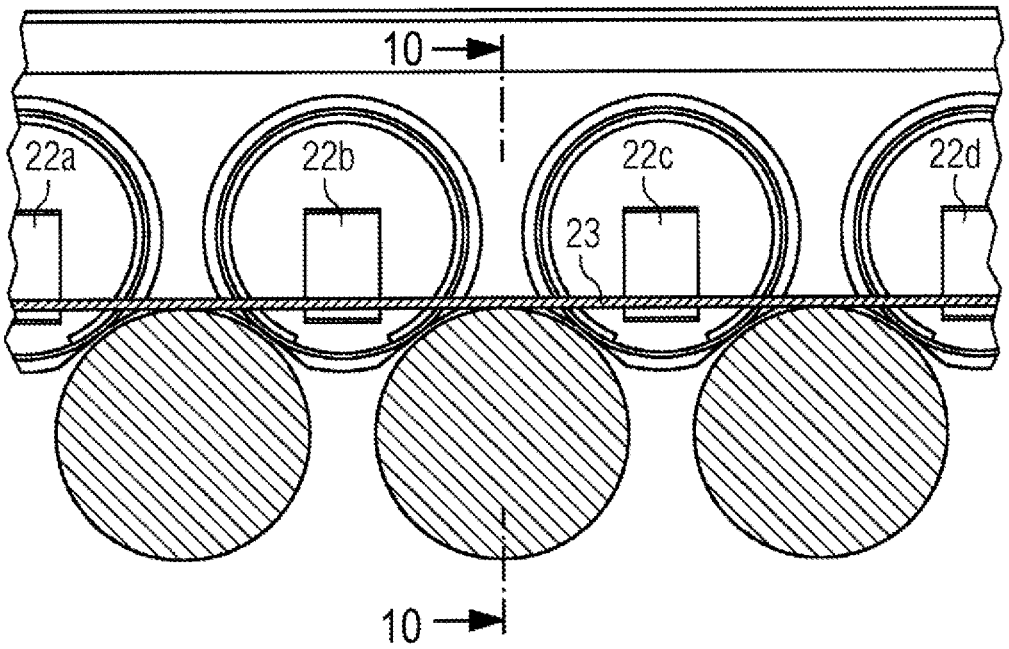
FIG. 9 shows a device according to the invention, having wear-body guide rollers in the guiding position.

FIG. 9 shows a view which is largely analogous to that of FIG. 7 and in which reference signs for the parts which have been described in FIG. 7 have been dispensed with for reasons of clarity. The wear-body guide rollers 22*a*, 22*b*, 22*c*, 22*d* of FIG. 7 are in the guiding position. The metal strip 23 is guided by the wear-body guide rollers 22*a*, 22*b*, 22*c*, 22*d*.

Figure 10:
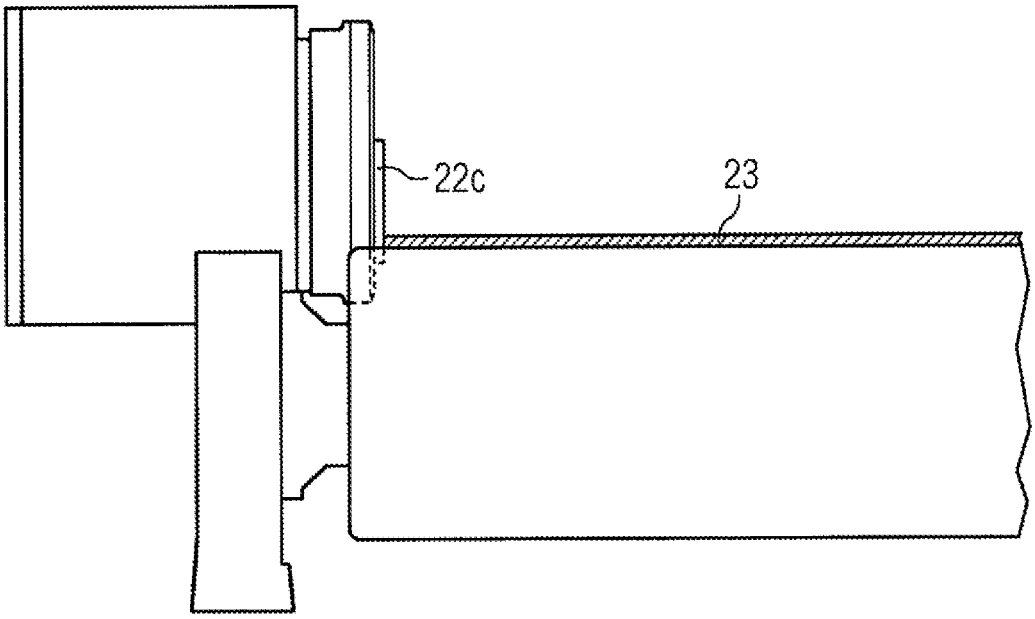
FIG. 10 shows a view along the section C-C of FIG. 9.

FIG. 10 shows a view along the section 10-10 of FIG. 9, in the direction of the wear-body guide roller 22*c*, wherein the guide plane is not separately illustrated.

The roller faces of the wear-body guide rollers 22*a*, 22*b*, 22*c*, 22*d* in FIGS. 7 to 10, when viewed from the wear face in the direction of the metal strip, protrude from the wear face both in the parking position as well as in the guiding position. Said roller faces are guided through an opening of the wear face of the respective wear bodies 21*a*, 21*b*, 21*c*, 21*d* and protrude from this wear face.

By pivoting the wear bodies 21*a*, 21*b*, 21*c*, 21*d*, the position of the openings of the wear faces is modified between FIG. 7 and FIG. 9. The wear-body guide rollers 21*a*, 21*b*, 21*c*, 21*d* protruding from these openings are accordingly repositioned and after pivoting of the wear bodies 21*a*, 21*b*, 21*c*, 21*d* protrude from these openings. Adjusting the latter to the guiding position is performed accordingly.

The wear-body guide rollers 22*a*, 22*b*, 22*c*, 22*d*, for example, may be in each case fastened to rotary readjustment modules, as provided with the reference sign 13 in FIG. 4, and by way of the latter may be rotatable and readjustable to various positions. The wear-body guide rollers could also be fastened to the wear bodies or to the main body module.

Figure 11:
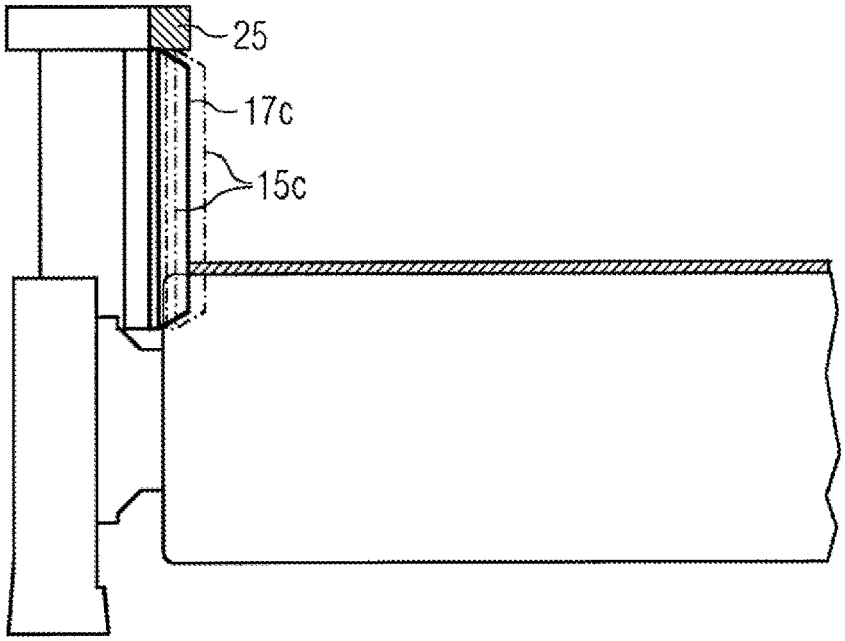
FIG. 11 shows a figure which is largely analogous to FIG. 6, having a wear face which in terms of spacing from the guide plane has been readjusted.

FIG. 11 shows a figure which is largely analogous to that of FIG. 6. In addition to FIG. 6, part of the guide plane having the reference sign 25 is also illustrated. The wear body 15*c*, having a solid border, is illustrated in a position in which the wear face 17*c* thereof lies in the same plane as the guide plane 25. The wear body 15*c*, having a dashed border, is illustrated in a position in which the spacing of the wear face thereof from the guide plane has been readjusted, shown presently increased. The wear body, by movement which is perpendicular to the guide plane is pushed out of the guide plane by a readjustment device, not shown in detail.

Figure 12:
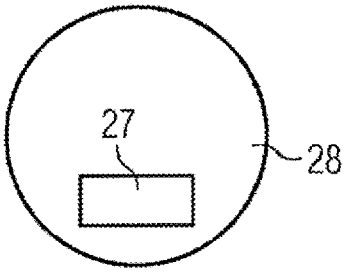
FIGS. 12 and 13 show openings and clearances of the wear face of a wear body.
Figure 13:
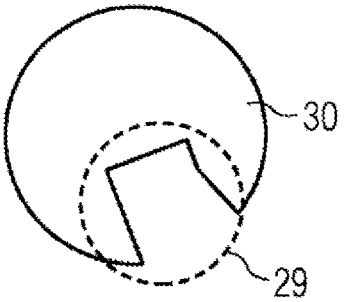

FIGS. 12 and 13 show the difference between a clearance of the wear face of a wear body and an opening of the wear face of a wear body.

An opening of the wear face is understood to mean a hole 27 in the wear face 28, which is entirely surrounded by the wear face 28, as shown in FIG. 12. By contrast, FIG. 13, having a dashed border, shows a clearance 29 of the wear face 30, which is not entirely surrounded by the wear face 30.

Figure 14:
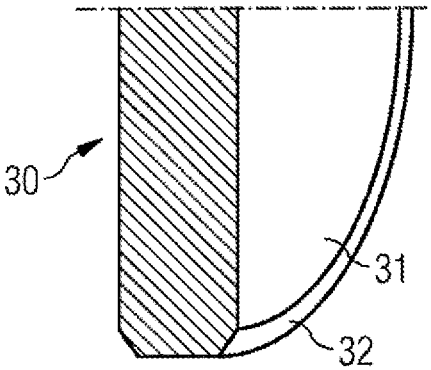
FIGS. 14 to 20 show various embodiments of a wear body.

FIG. 14 shows a fragment of an embodiment of a wear body 30 in the non-worn state. The wear body 30 is a round disk having a planar wear face 31. The wear body is chamfered on the periphery 32.

Figure 15:
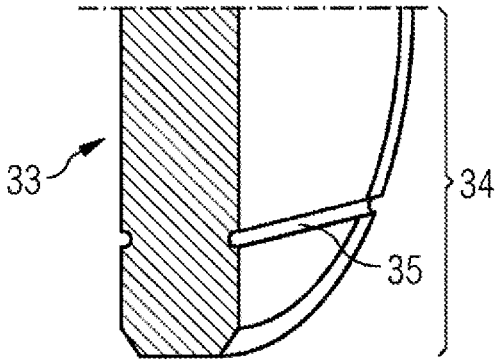

FIG. 15 shows a fragment of an embodiment of a wear body 33 in the non-worn state. The wear body 33 is a round disk having a substantially planar wear face 34. A guide spline 35 which is present from the outset in the wear face 34 as guide contours for guiding the metal strip is illustrated. The wear body is chamfered on the periphery 36.

Figure 16:
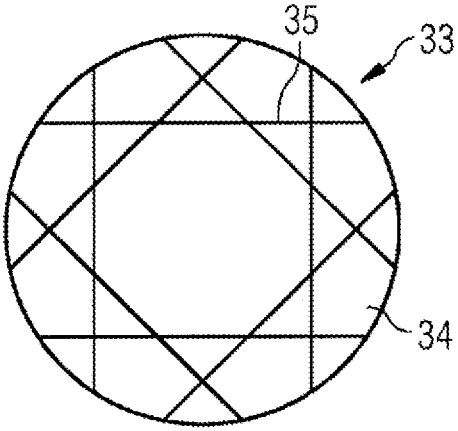

FIG. 16 shows a wear body 33 according to FIG. 15, in a lateral view compared to FIG. 15, onto the wear face 34. A plurality of guide splines 35 are seen.

Figure 17:
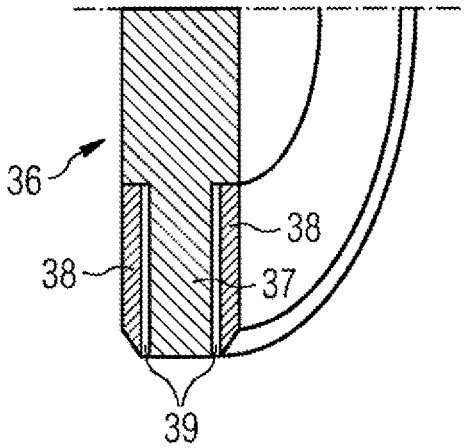

FIG. 17 shows a fragment of an embodiment of a wear body 36 in the non-worn state. An external and comparatively soft layer 38 for configuring guide splines during operation is present on a support material 37. A comparatively hard layer 39 which impedes deeper cuts lies between this external layer 38 and the support material 37.

These two surface coatings, i.e. layer 38 and layer 39, are attached on either side of the wear body 36 so as to be symmetrical, such that the wear body 36 after wear on one side may be simply reversed and the other and identically specified side is thus turned to face the metal strip and is worn.

Figure 18:
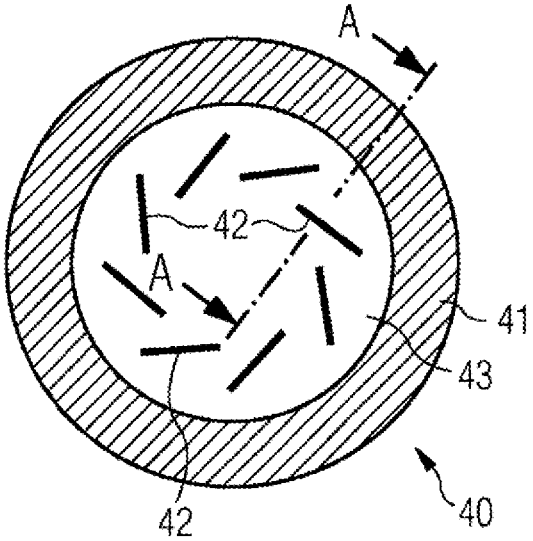

FIG. 18 shows a lateral view onto a wear body 40. The wear face 41 thereof extends on the circumference thereof. A plurality of mutually separate and individual elevations 42 from a face 43 of the wear body 40 which lies in the same plane as the wear face 41 are present outside the wear face 41 as guide elevations 42.

Figure 19:
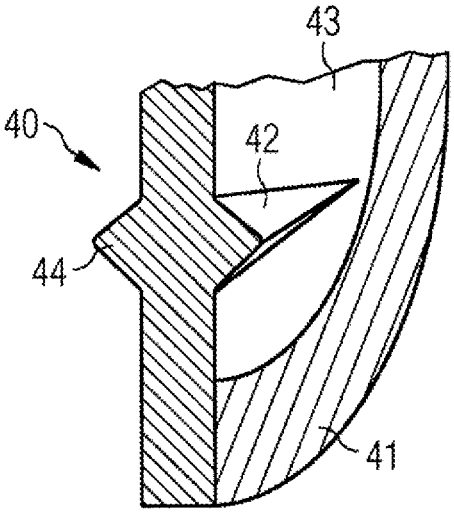

FIG. 19 shows a fragment of a section along the line A-A through the wear body 40 of FIG. 18. The profile of a guide elevation 42 is seen. Also, a guide elevation 44 is likewise present on the other side of the wear body 40. The body 40 is configured as a round disk.

Figure 20:
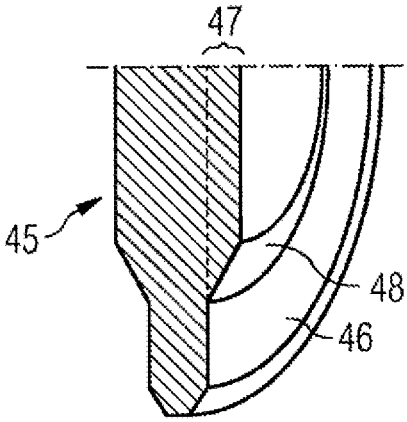

FIG. 20 shows a fragment of a wear body 45 having an elevation 47 in relation to the plane of the wear face 46 on a periphery of the wear face 46, so as to be beside the wear face 46. The elevation 47 is present on this entire periphery of the wear face 46. This elevation is embodied such that its height increases as the spacing from the periphery of the wear face increases, producing a so-called run-up slope 48. During operation, the run-up slope 48 and also the guide elevations 42 and 44 from FIGS. 18 and 19 constrict the lateral space for the metal strip. The constriction forms a resistance to climbing of the metal strip.

Although the invention has been illustrated and described in more detail by the preferred exemplary embodiments, the invention is not limited by the disclosed examples, and other variants may be derived therefrom by a person skilled in the art without departing from the scope of the invention.

LIST OF REFERENCE SIGNS

1 Device for laterally guiding a metal strip running over a roller table
2 Metal strip
3 Driver
4*a*, 4*b* Run-in rulers
5 Wear strip
6 Guide plane
7 Main body module
8 Support body

9 Wear plate
10 Guide plane
11*a*, 11*b*, 11*c*, 11*d* Roller table rollers
12 Wear body
12*a* Wear face
13 Rotary readjustment module
14 Main body module
15*a*, 15*b*, 15*c*, 15*d* Wear body
16*a*, 16*b*, 16*c* Roller table rollers
17*a*, 17*b*, 17*c*, 17*d* Wear faces
18 Metal strip
19 Guide plane
20*a*, 20*b*, 20*c* Wear track
21*a*, 21*b*, 21*c*, 21*d* Wear body
22*a*, 22*b*, 22*c*, 22*d* Wear-body guide rollers
23 Metal strip
24 Guide plane
25 Guide plane
26 Guide plane
27 Hole
28 Wear face
29 Clearance
30 Wear face
31 Wear face
32 Periphery
33 Wear body
34 Wear face
35 Guide spline
36 Periphery
37 Support material
38 Layer
39 Layer
40 Wear body
41 Wear face
42 Guide elevations
43 Face
44 Guide elevation
45 Wear body
46 Wear face
47 Elevation
48 Run-up slope

LIST OF CITATIONS

Patent Literature

DE1427923
DE69408332T2
U.S. Pat. No. 2,818,954
JP05161917

The invention claimed is:

1. A device for laterally guiding a metal strip running over a metal-strip conveying device, the device comprising:

at least one main body module having a substantially vertical guide plane, the guide plane being positioned and oriented to face toward a lateral edge of the metal strip as the metal strip is conveyed by the conveying device;

at least one wear body which is located to be passed by the lateral edge of the metal strip as the metal strip is conveyed by the conveying device, the at least one wear body having a respective wear face, which may be contacted by the lateral edge of the metal strip being conveyed, the at least one wear body and the respective wear face thereof is rotatable to a plurality of defined rotary positions which exposes different areas of the wear face to control the lateral edge of the metal strip; and the wear face is substantially planar, and in all rotary positions, the wear face is parallel with the guide plane.

2. The device as claimed in claim 1, further comprising a plurality of the wear bodies, each wear body having a respective wear face, each wear body and the wear face thereof is rotatable to a plurality of the defined rotary positions, and at least one of the wear bodies is rotatable independently of others of the wear bodies to the rotary positions thereof.

3. The device as claimed in claim 1, further comprising a plurality of the wear bodies, each wear body having a respective wear face, each wear body and the wear face thereof is rotatable to a plurality of the defined rotary positions, and at least one of the wear bodies is rotatable dependent on at least one other of the wear bodies.

4. The device as claimed in claim 1, further comprising at least one of the wear bodies is adjustable for adjusting the spacing of the wear face thereof from the guide plane of the main body module and toward or away from the lateral edge of the metal strip.

5. The device as claimed in claim 4, further comprising for at least one of the wear bodies, the spacing of the wear face from the guide plane of the main body module is readjustable independently of the spacing from the guide plane of the other wear bodies.

6. The device as claimed in claim 4, further comprising a plurality of the wear bodies for which the spacing of the wear faces thereof from the guide plane of the main body module is readjustable, and the spacing of at least one of the wear bodies is readjustable dependent on at least one other of the wear bodies.

7. The device as claimed in claim 1, further comprising at least one of the wear faces having a clearance into it or an opening in it;

at least one wear-body guide roller located and configured to be guided through the clearance of the at least one wear face of a wear body or through the opening of the at least one wear face of a wear body to be received in the clearance or the opening and there at least partially protrude from the wear face.

8. The device as claimed in claim 7, further comprising at least one wear body guide roller which is adjustable to at least:

one parking position where the metal strip cannot be guided by the wear body guide rollers and one guiding position at which the metal strip may be guided by the wear body guide rollers.

9. The device as claimed in claim 8, wherein in the guiding position, a roller face of the wear body guide roller is guided through the clearance of the wear face of a wear body or guided in the opening of the wear face of a wear body and the roller at least partially protrudes from the wear face.

10. The device as claimed in claim 1, further comprising at least some of the wear bodies are laterally chamfered and at the chamfers are there not parallel to the guide plane, but the chamfers are there inclined away from the lateral edge of the metal strip outward of the wear face on the wear bodies.

11. The device as claimed in claim 1, further comprising at least one wear face has guide contours located and configured for guiding the metal strip when the metal strip engages the at least one wear face.

12. The device as claimed in claim 1, further comprising at least one of the wear bodies has at least one support material having a coating thereon.

13. The device as claimed in claim 1, further comprising each of the wear bodies is symmetrical such that the wear body comprises at least two identically developed opposite sides, and each side having a respective one of the wear faces.

14. The device as claimed in claim 1, further comprising the wear body has at least one guide elevation, a run-up slope or a discrete elevation located and configured for guiding the lateral edge of the strip out of its path of travel past the wear body.

15. The device as claimed in claim 1, further comprising at least one rotatable wear body guide roller supported by at least one of the wear bodies at the wear face thereof wherein the wear body guide roller at least partially protrudes from the respective wear face, and the at least one wear body guide roller is movable along with movement of the respective wear face to be selectively in position to guide the conveying of the metal strip or out of position to guide the conveying of the metal strip.

16. A method for laterally guiding a metal strip running over a metal-strip conveying device, comprising:

providing a device for laterally guiding the metal strip, wherein the device comprises a main body module having a guide plane facing a lateral edge of the metal strip being guided and at least one wear body at the main body module, and the wear body having a substantially planar wear face;

the method comprising:

passing a metal strip, which is the first metal strip of the method, through the metal strip conveying device;

after the first metal strip has passed through the metal-strip conveying device and before a second metal strip begins to pass through the metal-strip conveying device, rotating the wear body from a defined first rotary position to a defined second rotary position thereof, wherein the wear face in all of the rotary positions of the respective wear body is parallel with the guide plane.

17. The method as claimed in claim 14, further comprising:

performing a first lateral guiding phase on at least one lateral side of the metal strip applied by means of the main body module and optionally applied by wear bodies and/or by wear-body guide rollers; and performing a subsequent second lateral guiding phase comprising lateral guiding on at least one side of the metal strip only by the wear bodies.

18. The method as claimed in claim 17, further comprising, after the first lateral guiding phase, readjusting at least one of the wear bodies and/or readjusting the at least one main body module to a position in which the wear face of the wear body lies outside the guide plane.

19. The method as claimed in claim 17, further comprising, during the second lateral guiding phase, performing the lateral guiding on at least one side of the metal strip by a plurality of the wear bodies, and wherein during the second lateral guiding phase, at least one of the wear bodies is caused to lose contact between the wear face of the one wear body as the metal strip is readjusted away from the metal strip;

then rotating the one wear body about a rotation axis to a new rotary position, and then while restoring contact between the wear face of the one wear body and the metal strip by readjusting the wear body toward the metal strip.

20. The method as claimed in claim 17, further comprising, during the lateral guiding, switching between the sliding guiding by the wear bodies and rolling guiding by the rollers.

21. The method as claimed in claim 16, wherein the device for laterally guiding comprises at least one wear-body guide roller, the method comprising:

performing a first lateral guiding phase on at least one lateral side of the metal strip applied by the main body module and optionally applied by wear bodies and/or wear-body guide rollers; and performing a subsequent second lateral guiding phase comprising lateral guiding on at least one side of the metal strip;

only by wear-body guide rollers or;

by wear bodies and wear-body guide rollers.

22. The method as claimed in claim 21, further comprising the lateral guiding comprises both sliding guiding by the wear bodies and rolling guiding by the rollers.

* * * * *